US005448030A

United States Patent [19]

Yamamoto et al.

[11] Patent Number: 5,448,030

[45] Date of Patent: Sep. 5, 1995

[54] GAS INSULATED CIRCUIT BREAKER

[75] Inventors: Naoyuki Yamamoto; Akira Suzuki; Nobuyuki Takeuchi, all of Hitachi; Osamu Tsuji, Mito; Noriaki Munakata, Juuou, all of Japan

[73] Assignees: Hitachi, Ltd., Tokyo; Hitachi Electric Systems Co., Ltd., Ibaraki, both of Japan

[21] Appl. No.: 102,984

[22] Filed: Jul. 28, 1993

[30] Foreign Application Priority Data

Aug. 7, 1992 [JP] Japan ..... 4-211502

[51] Int. Cl.[6] ..... H01H 33/82

[52] U.S. Cl. ..... 218/1; 218/84; 218/2

[58] Field of Search ..... 200/17 R, 18, 144 R, 200/145, 148 R, 148 A, 148 B, 148 D, 148 F, 150 R, 150 F

[56] References Cited

U.S. PATENT DOCUMENTS 4,839,476 6/1989 Okuno ..... 200/17 R
5,128,502 7/1992 Hux ..... 200/145

FOREIGN PATENT DOCUMENTS 186171 12/1985 European Pat. Off. ..... H01H 3/30
61-161628 7/1986 Japan ..... H01H 33/40
63-304542 12/1988 Japan ..... H01H 33/40
64-6340 1/1989 Japan ..... H01H 33/40
3-64815 3/1991 Japan ..... H01H 33/42

*Primary Examiner*—A. D. Pellinen
*Assistant Examiner*—Michael A. Friedhofer
*Attorney, Agent, or Firm*—Fay, Sharpe, Beall, Fagan, Minnich & McKee

[57] ABSTRACT

A gas insulated circuit breaker includes a closed tank filled with an insulation gas, one pair of separable contacts disposed in the closed tank, a supporting frame supporting the closed tank, an opening spring for performing an opening operation of the pair of contacts, a closing spring for performing a closing operation of the pair of contacts, and an actuating mechanism box accommodating an opening coil which is adapted to receive a circuit opening command for the contacts, a closing coil which is adapted to receive a circuit closing command for the contacts and an actuating mechanism for rendering the opening spring and the closing spring operative in response to an activation of the opening coil and the closing coil. A first spring casing accommodates the opening spring and is secured on the closed tank, and a second spring casing accommodates the closing spring and is secured on the supporting frame.

8 Claims, 5 Drawing Sheets

GAS INSULATED CIRCUIT BREAKER

BACKGROUND OF THE INVENTION

1. Field of the Invention

The present invention relates to a gas insulated circuit breaker and, in particular, relates to a gas insulated circuit breaker which employs an opening spring and a closing spring for circuit breaking and closing operations performed in its circuit breaking unit.

2. Description of Related Art

A gas insulated circuit breaker is, in general, composed of a circuit breaking unit including a pair of separable contacts disposed in a closed tank filled with $SF_6$ gas, an actuating mechanism box which is ordinarily disposed outside the closed tank and which may accommodate an opening coil and a closing coil for providing an operation command to an actuating mechanism also accommodated therein, and a mechanism case which accommodates a link mechanism coupling between the actuating mechanism and a movable contact in the circuit breaking unit. For the actuating mechanism which is designed to cause circuit opening and closing operations in the circuit breaking unit, many types of actuating mechanisms, such as a pneumatic type actuating mechanism, a hydraulic type actuating machanism and a spring type actuating mechanism, are in use, and such actuating mechanisms are ordinarily accommodated in the actuating mechanism boxes.

JP-A-61-161628(1986), which corresponds to European Patent Publication No. 0186171, discloses a spring type actuating mechanism which uses an opening spring and a closing spring for circuit breaking and closing operations in the circuit breaking unit, wherein both the opening spring and the closing spring are disposed in an actuating mechanism box.

JP-A-63-304542(1988), which corresponds to U.S. Pat. No. 4,839,476, also discloses a spring type actuating mechanism, wherein both an opening spring and a closing spring are constituted by torsion bars and are disposed in an actuating mechanism box.

Further, JP-A-64-6340(1989) also discloses a spring type actuating mechanism which uses an opening spring and a closing spring for circuit breaking and closing operations in a circuit breaking unit, wherein the opening spring is disposed in an actuating mechanism box. However, the closing spring is disposed outside the actuating mechanism box.

With the gas insulated circuit breakers as disclosed such as in JP-A-61-161628(1986) and JP-A-63-304542(1988), however, wherein both the opening spring and the closing spring are disposed in the actuating mechanism box, a space occupying rate of the springs in the actuating mechanism box rises to thereby increase the size of the actuating mechanism box.

Further, with the gas insulated circuit breaker as disclosed in JP-A-64-6340(1989), for example, wherein only the opening spring is disposed in the actuating mechanism box, a load comparable to an actuating force of the opening spring acts on the secured end side of the opening spring as a reaction force, and a vibration caused thereby when the actuating force is exerted is directly transmitted onto the actuating mechanism box, and for these reasons there was a possibility that contacts such as in electromagnetic contactors and auxiliary contactors disposed in the actuating mechanism box are erroneously operated. Accordingly it was necessary to construct the actuating mechanism box to be sufficiently strong and large in order to avoid the above problems.

SUMMARY OF THE INVENTION

An object of the present invention is to provide a gas insulated circuit breaker in which a vibration transmitted to an actuating mechanism box is suppressed and the size of the actuating mechanism box is reduced.

For achieving the above object, in a gas insulated circuit breaker according to the present invention which comprises at least one pair of separable contacts disposed in a closed tank supported on a supporting frame, an opening spring and a closing spring for performing opening and closing operations of the contacts and an actuating mechanism box accommodating an opening coil and a closing coil receiving circuit opening and closing commands for the contacts, both the opening spring and the closing spring are disposed outside the actuating mechanism box.

Further, in a gas insulated circuit breaker according to the present invention which comprises at least one pair of separable contacts disposed in a closed tank supported on a supporting frame, an opening spring and a closing spring for performing opening and closing operations of the contacts and an actuating mechanism box accommodating an opening coil and a closing coil receiving circuit opening and closing commands for the contacts, a first spring case for accommodating the opening spring and a second spring case for accommodating the closing spring are provided outside the actuating mechanism box and supported respectively on the closed tank and on the supporting frame.

In the gas insulated circuit breaker according to the present invention as explained above, both the opening spring and the closing spring are disposed outside the actuating mechanism box, whereby the direct transmission of a vibration, which is caused when a tensioned force of the springs are released onto the actuating mechanism box, is suppressed and an erroneous operation of contacts of electromagnetic contactors and auxiliary contactors in the actuating mechanism box is avoided, and accordingly the size of the actuating mechanism box is reduced because of an increase of an arrangement freedom of the electromagnetic contactors and the auxiliary contactors in the actuating mechanism box due to the vibration and further because of a reduced thickness of constituent members for the actuating mechanism box and an elimination of reinforced elements therefor.

Further, in the gas insulated circuit breaker according to the present invention as explained above, the first and second spring cases, each accommodating respectively the opening spring and the closing spring, are supported and secured respectively at the closed tank and the supporting frame. Thereby the vibration caused during the release of the tensioned force of these springs is received by making use of already existing strong structural elements such as the closed tank and the supporting frame, and a transmission of the vibration onto the actuating mechanism box is suppressed and an erroneous operation of the contacts of the electromagetic contactors and the auxiliary contactors in the actuating mechanism box is avoided. Accordingly the size of the actuating mechanism box is reduced because of an increase of arrangement freedom of the electromagnetic contactors and the auxiliary contactors in the actuating mechanism box due to the vibration suppression.

BRIEF DESCRIPTION OF THE DRAWINGS

FIG. 3(*b*) is the same view as FIG. 3(*a*) but under another condition when the closing spring just initiates a tensioning operation from a condition wherein the circuit closing operation has just completed;

FIG. 3(*c*) is the same view as FIG. 3(*a*) but under still another condition when the gas insulated circuit breaker has initiated a circuit breaking operation from a condition wherein the gas insulated circuit breaker is closed and the closing spring is tensioned;

DESCRIPTION OF THE PREFERRED EMBODIMENTS

Hereinbelow, embodiments of the present invention are explained with reference to the drawings.

Figure 1:
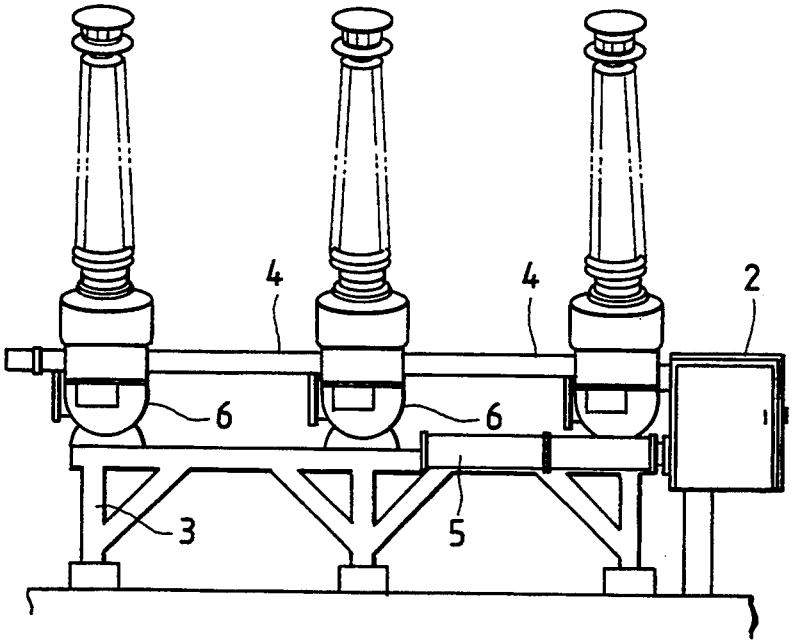
FIG. 1 is a front view of one embodiment of a gas insulated circuit breaker according to the present invention.
Figure 2:
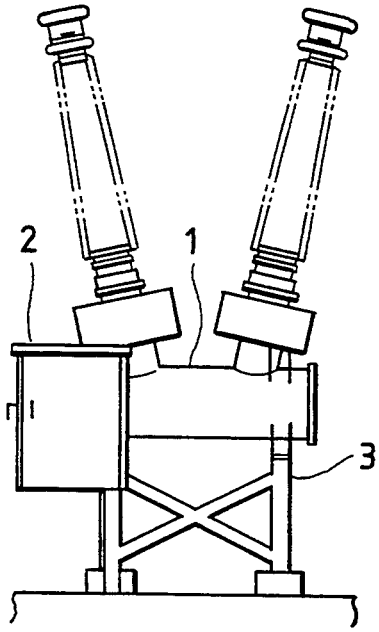
FIG. 2 is a side view of the gas insulated circuit breaker as shown in FIG. 1.

FIG. 1 and FIG. 2 are respectively a front view and a side view of a so called three phase collective actuation type gas insulated circuit breaker according to one embodiment of the present invention.

A closed tank type gas insulated circuit breaker having components for three phases is supported and secured on a common supporting frame 3 secured on an installation plane. Within a closed tank 1 $SF_6$ gas is filled and as well a circuit breaking unit including a pair of separable contacts is constituted. A link coupled to a movable contact of the pair of separable contacts is extended into a mechanism casing 6 connected at one axial end of the closed tank 1 while maintaining air tightness of the closed tank 1, and the mechanism casings 6 for the respective three phases are respectively connected by first spring casings 4. Within the respective first spring casing 4 are accommodated a connecting rod coupling with the links for the respective phases and an opening spring of which detail will be explained later. Further one end of the connecting rod is extended into an actuating mechanism box 2 which is secured on the installation plane so that the respective first spring casings 4 are mechanically secured to the closed tanks 1 via the mechanism casings 6. Near the first spring casings 4, a second spring casing 5 which is extending in parallel and in the same direction as the first casings 4 is arranged. The second spring casing 5 is mechanically supported and secured on the supporting frame 3 and as well one end of the second spring casing 5 is connected to the actuating mechanism box 2.

Figure 4:
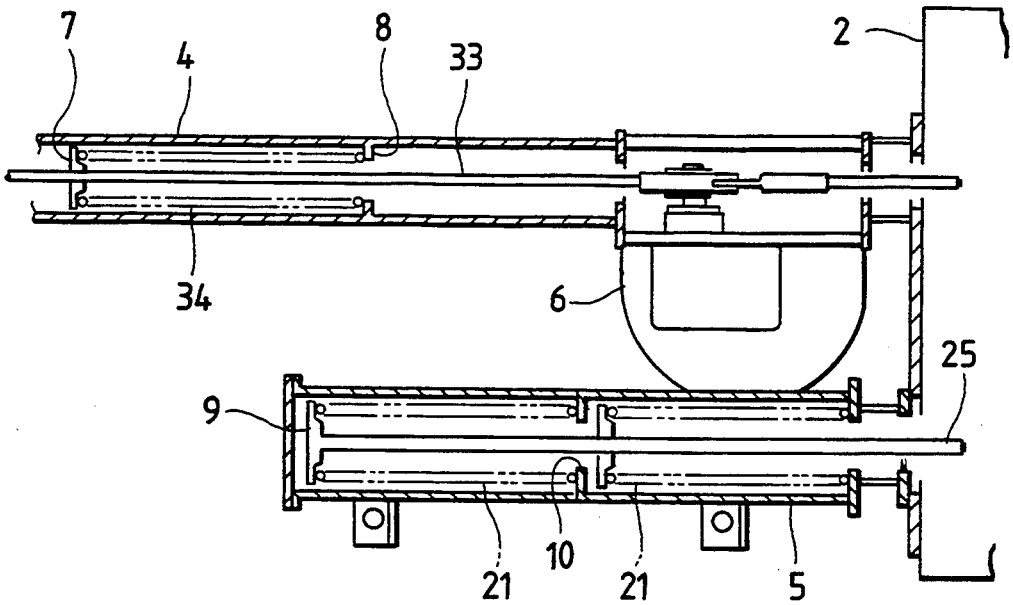
FIG. 4 is a cross sectional view of first and second spring cases of the gas insulated circuit breaker shown in FIG. 1.

The details of connecting portions between the actuating mechanism box 2 and the first and second spring casings 4 and 5 are illustrated in FIG. 4 which is a cross sectional view of a major portion of FIG. 1.

The first spring casings 4 are mechanically secured to the closed tanks 1 via the respective mechanism casings 6 and the second casing 5 is mechanically secured to the supporting frame 3, and further the respective right ends of the first and second spring casings 4 and 5 are connected to the actuating mechanism box 2 which is separately secured on the installation plane as indicated above. A movable side spring seat 7 for the opening spring 34 is secured on a connecting rod 33 in the first spring casing 4, a stationary side spring seat 8 for the opening spring 34 is formed at the inner face of the first spring casing 4 and the opening spring 34 is disposed between the movable side spring seat 7 and the stationary side spring seat 8. The opening spring 34 may be either disposed non-collectively in the respective first spring casings 4 arranged between the respective closed tanks 1 for the respective phases, or disposed collectively in a single first spring casing 4 arranged between two closed tanks 1 for the adjacent two phases. Similarly, in the second spring casing 5 a rod 25 is disposed, a movable side spring seat 9 for a closing spring 21 is secured on the rod 25, a stationary side spring seat 10 for the closing spring 21 is formed around the inner face of the second spring casing 5, and between the movable side spring seat 9 and the stationary side spring seat 10 the closing spring 21 is disposed. The closing spring 21 can be constituted either by a plurality of springs as illustrated in FIG. 4 or a single spring.

A relationship between the opening spring 34 and the closing spring 21 which are disposed outside the actuating mechanism box 2 and the actuating mechanism disposed therein in connection with circuit breaking and closing operations of the gas insulated circuit breaker is explained with reference to FIG. 3(*a*), FIG. 3(*b*) and FIG. 3(*c*).

One end of the rod 25 is connected to the closing spring 21 and the other end of the rod 25 is connected to a gear 24 at a position eccentric from the rotation axis 11 thereof. The gear 24 is connected to a gear mounted on a rotation axis of an electric motor 22 via a series of spur gears 23. Accordingly, when the electric motor begins to rotate after the tensioned force of the closing spring 21 has been released for circuit closing, the series of spur gears 23 and the gear 24 are rotated in the directions indicated by arrows in FIG. 3(*b*), whereby the closing spring 21 is compressed via the rod 25 to store a tensioned force. At the time when a toggle mechanism consisting of the rod 25 and the gear 24 exceeds its dead center, a cam 26 which is mounted on the rotation axis 11 has been similarly rotated in the direction shown by an arrow and comes to a position as shown in FIG. 3(*c*) wherein a cam roller 27 for use in the closing operation formed on the cam 26 engages with a closing operation locking device represented by a lever 28 to thereby prevent the rotating axis from further rotating in the arrowed direction by the tensioned force of the closing spring 21.

Figure 3A:
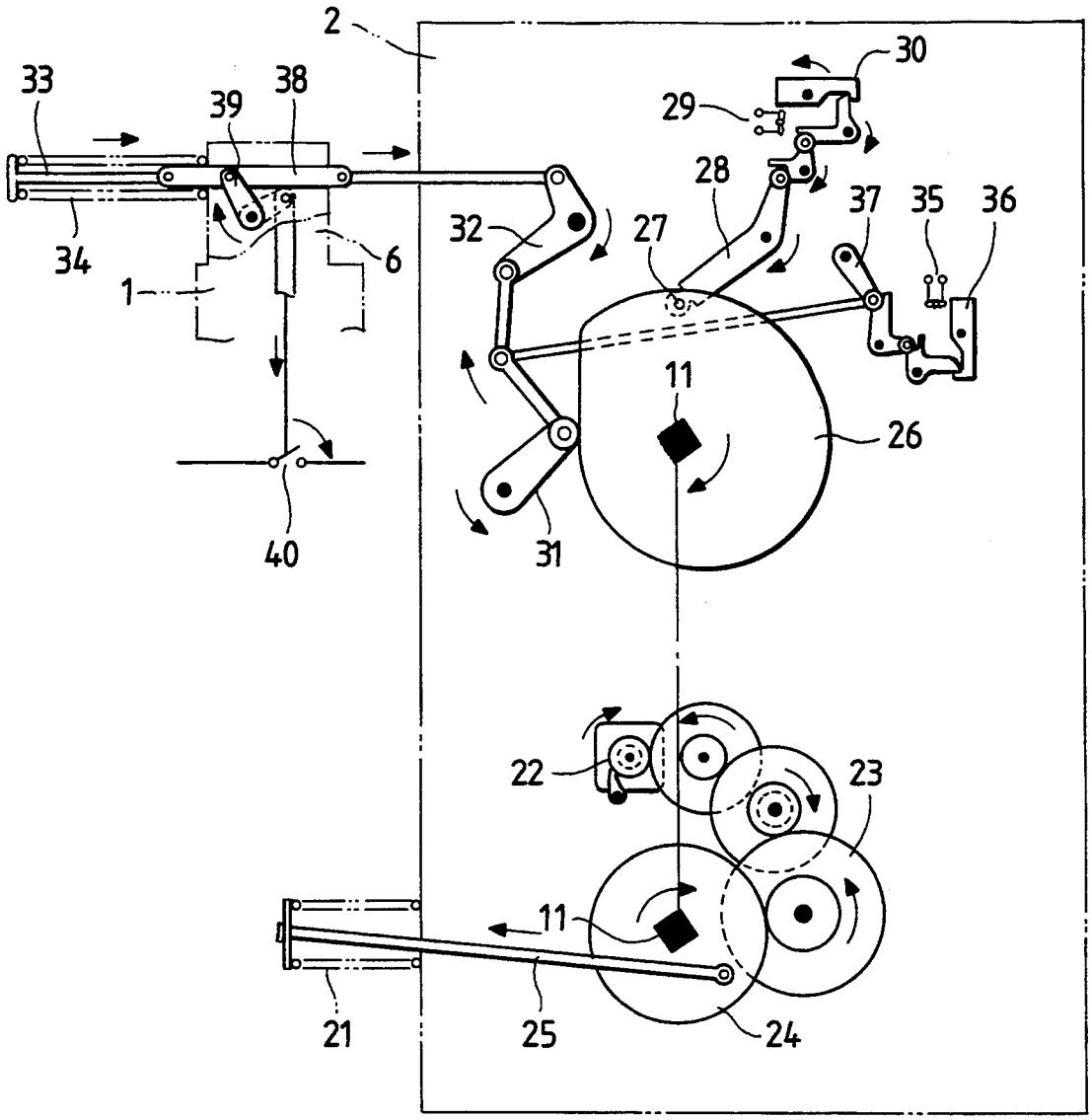
FIG. 3(*a*) is a view for explaining an actuating principle of an actuating mechanism accommodated in an actuating mechanism box of the gas insulated circuit breaker shown in FIG. 1 under a condition when the gas insulated circuit breaker has initiated a circuit closing operation from a condition wherein the gas insulated circuit breaker is opened and a closing spring therefor is tensioned.
Figure 3B:
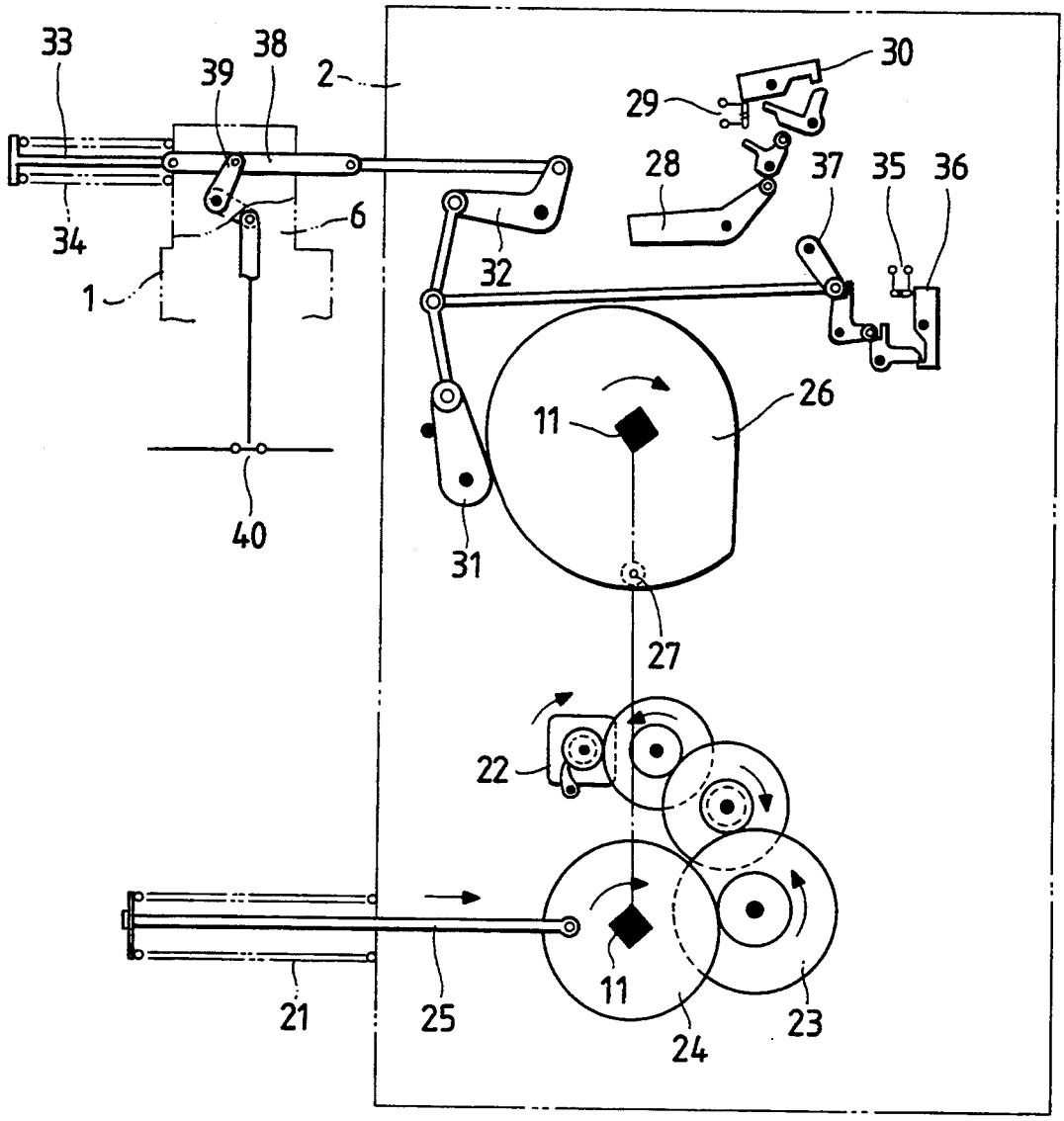
Figure 3C:
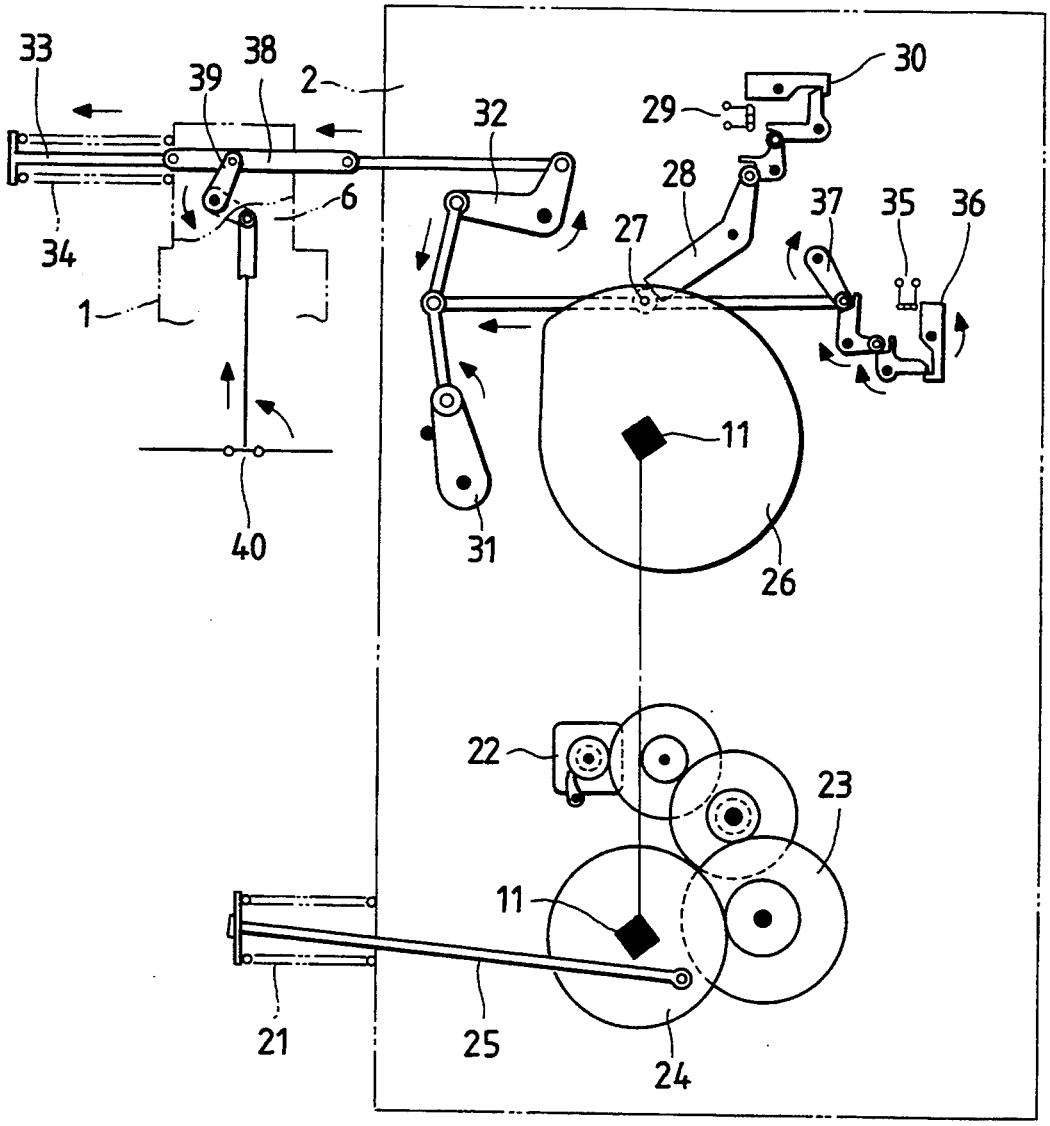

FIG. 3(*b*) represents the state after completing the circuit closing operation of the circuit breaking unit 40 of the gas insulated circuit breaker wherein the opening spring 34 is already tensioned by the closing spring 21 through a rotation of the cam 26 during circuit closing operation as seen from FIG. 3(*a*).

When a circuit opening command is provided to an opening coil 35 under a condition illustrated in FIG. 3(*c*) wherein tensioning of the closing spring 21 is completed after completion of circuit closing as shown in FIG. 3(*b*), a hook 36 is rotated by an electromagnetic device in the direction indicated by an arrow to disengage the coupling with a link 37 and the tensioned force of the opening spring 34 is released while rotating a lever 31 and a lever 32 counterclockwise, and while moving an operating rod 38 and a rotary shaft lever 39 in the indicated direction to complete a circuit breaking operation of the circuit breaking unit 40.

Thereafter, when a closing command is provided to a closing coil 29, a hook 30 is rotated by an electromagnetic device in the indicated direction to disengage the coupling with the link 28 as shown in FIG. 3(*a*), whereby the tensioned force of the closing spring 21 is released to rotate about the rotation axis 11 in the clockwise direction while rotating the lever 31 in the counterclockwise and the lever 32 in the clockwise direction through the cam 26 to thereby complete the tensioning of the opening spring 34 through the releasing of the tensioned force of the closing spring 21 as seen from FIG. 3(*a*).

The closing spring 21 and the opening spring 34 repeat tensioning and tensioned force releasing every time the circuit breaking and closing operations are performed as explained above, and constitute a vibration generating source. In conventional gas insulated circuit breakers, because at least one of the closing spring 21 and the opening spring 34 is accommodated in the actuating mechanism box 2, there is a high posibility of an erroneous operation of electromagnetic contactors and auxiliary contactors disposed in the actuating mechanism box due to the generated vibration.

On the other hand, in the present embodiment, the opening spring 34 is accommodated in the first spring casing 4 disposed between the adjacent closed tanks 1 for the respective phases and coupled thereto, and the closing spring 21 is accommodated in the second spring casing 5 coupled to the supporting frame 3, so that the closing spring 21 as well as the opening spring 34 are disposed outside the actuating mechanism box 2. Thus, the vibration caused by these closing and opening springs 21 and 34 is received by the strong supporting frame 3 and the strong closed tanks 1 for the respective phases, and thereby transmission of the vibration up to the actuating mechanism box is suppressed. As a result, any erroneous operation of the electromagnetic contactors and the auxiliary contactors disposed in the actuating mechanism box is prevented and the structure of the actuating mechanism box is simplified.

Further, in the present embodiment the closing spring 21 and the opening spring 34 are arranged substantially in parallel and respective ends of the first and second spring casings 4 and 5 accommodating the respective springs 21 and 34 are connected to the actuating mechanism box. Therefore, the direction of the suppressed vibration transmitted from the closing and opening springs 21 and 34 to the actuating mechanism box 2 is limited to a single direction. Accordingly, the electromagnetic contactors and the auxiliary contactors can be easily arranged in the actuating mechanism box so as to prevent any erroneous operation thereof due to the unidirectional vibration. Namely, the electromagnetic contactors and the auxiliary contactors are resistive to a vibration directed perpendicular to the moving direction of movable contacts of the contactors, but less resistive to a vibration directed parallel to the moving direction of the movable contacts with regard to their erroneous operation. Accordingly, since the vibration directions are limited to a single direction, it is easy to employ an arrangement of the electromagnetic contractors and the auxiliary contactors which has sufficient resistance to the unidirectional vibration.

Further, although in the present embodiment the first spring casings 4 and the mechanism casings 6 are formed sperately, however the first spring casings 4 and the mechanical casings 6 can be formed integrally to simplify the entire structure.

Still further, although in the present embodiment the first and second spring casings 4 and 5 are newly introduced for accommodating the respective opening and closing springs 34 and 21, the first and second casings 4 and 5 can instead be disposed within an installation plane determined by the three closed tanks 1 and the actuating mechanism box 2 without increasing the entire installation plane for the gas insulated circuit breaker.

Still further, in the present embodiment, the closing spring 21 is disposed at a lower position than that for the opening spring 34, however this positional relationship can be reversed if the actuating mechanism in the actuating mechanism box 2 is modified.

Figure 5:
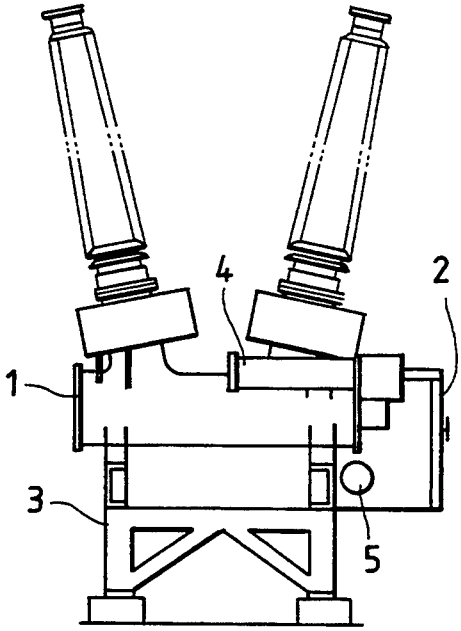
FIG. 5 is a front view of another embodiment of the gas insulated circuit breaker according to the present invention.
Figure 6:
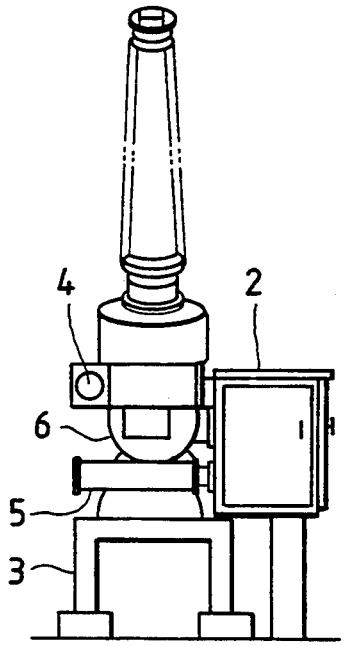
FIG. 6 is a side view of the gas insulated circuit breaker as shown in FIG. 5.

FIG. 5 and FIG. 6 are front and side views of a gas insulated circuit breaker according to another embodiment of the present invention.

In contrast to the previous embodiment which is directed to a three phase collective actuation type gas insulated circuit breaker, the present embodiment is directed to a single phase actuation type gas insulated circuit breaker wherein separate actuating devices for respective phases are provided. The first spring casing 4 accommodating an opening spring is arranged in parallel with the axial direction of the closed tank 1 and is supported and secured thereto. The second spring casing 5 accommodating a closing spring is arranged below and perpendicular to the axial direction of the closed tank 1, and is supported and secured on the supporting frame 3. In the present embodiment, as in the previous embodiment, the opening spring is accommodated in the first spring casing 4 secured to the closed tank 1 and the closing spring is accommodated in the second spring casing 5 secured to the supporting frame 3 so as to dispose the closing spring 21 as well as the opening spring 34 outside the actuating mechanism box 2. Thus, the vibration caused by these closing and opening springs 21 and 34 is received by the strong supporting frame 3 and the strong closed tank 1 and thereby transmission of the vibration up to the actuating mechanism box 2 is suppressed. As a result, any erroneous operation of the electromagnetic contactors and the auxiliary contactors disposed in the actuating mechanism box 2 is prevented and the structure of the actuating mechanism box 2 is also simplified.

According to the present invention, since the closing spring as well as the opening spring are disposed outside the actuating mechanism box in order that a vibration caused by these springs is not directly transmitted onto the actuating mechanism box, any erroneous operation of the electromagnetic contactors and the auxiliary contactors disposed in the actuating mechanism box is prevented.

Further, according to the present invention, since the spring casings accommodating the respective closing spring and opening spring are supported and secured respectively by the strong supporting frame and the closed tank, and the vibration caused by these springs is received by the strong supporting frame and the closed tank to thereby suppress transmission of the vibration up to the actuating mechanism box, an erroneous operation of the electromagnetic contactors and the auxiliary contactors is prevented and the structure of the actuating mechanism box is simplified.

We claim:

1. A gas insulated circuit breaker comprising:
a closed tank filled with insulation gas;
at least one pair of separable contacts disposed in said closed tank;
a supporting frame supporting said closed tank;
an opening spring for performing an opening operation of said pair of contacts;
a closing spring for performing a closing operation of said pair of contacts;
an actuating mechanism box accommodating an opening coil which is adapted to receive a circuit opening command for said contacts, a closing coil which is adapted to receive a circuit closing command for said contacts and an actuating mechanism for rendering said opening spring and said closing spring operative in response to an activation of said opening coil and said closing coil, respectively, wherein both said opening spring and said closing spring are disposed outside said actuating mechanism box;
a first spring casing accommodating said opening spring and supported and secured on said closed tank; and
a second spring casing accommodating said closing spring and supported and secured on said supporting frame.

2. A gas insulated circuit breaker according to claim 1, wherein said first spring casing and said second spring casing are arranged in parallel to each other.

3. A gas insulated circuit breaker comprising:
a closed tank filled with insulation gas;
at least one pair of separable contacts disposed in said closed tank;
a supporting frame supporting said closed tank;
an opening spring for performing an opening operation of said pair of contacts;
a closing spring for performing a closing operation of said pair of contacts;
an actuating mechanism box accommodating an opening coil which is adapted to receive a circuit opening command for said contacts, a closing coil which is adapted to receive a circuit closing command for said contacts and an actuating mechanism for rendering said opening spring and said closing spring operative in response to an activation of said opening coil and said closing coil, respectively, wherein both said opening spring and said closing spring are disposed outside said actuating mechanism box;
a first spring casing accommodating said closing spring and supported and secured on said closed tank; and
a second spring casing accommodating said opening spring and supported and secured on said supporting frame.

4. A gas insulated circuit breaker according to claim 3, wherein said first spring casing and said second spring casing are arranged in parallel to each other.

5. A gas insulated circuit breaker comprising:
three closed tanks, each corresponding to one phase of three phases and filled with insulation gas;
at least one pair of separable contacts disposed in each of said closed tanks;
a common supporting frame supporting said three closed tanks;
a common opening spring for performing an opening operation of said pairs of separable contacts;
a common closing spring for performing a closing operation of said pairs of separable contacts;
a common actuating mechanism box accommodating an opening coil which is adapted to receive a circuit opening command for said pairs of separable contacts, a closing coil which is adapted to receive a circuit closing command for said pairs of separable contacts and an actuating mechanism for rendering said common opening spring and said common closing spring operative in response to an activation of said opening coil and said closing coil, respectively, wherein both said common opening spring and said common closing spring are disposed outside said common actuating mechanism box;
a first spring casing accommodating said common opening spring, disposed between adjacent closed tanks and supported and secured on said adjacent closed tanks; and
a second spring casing accommodating said common closing spring and supported and secured on said supporting frame.

6. A gas insulated circuit breaker according to claim 5, wherein said first spring casing and said second spring casing are arranged in parallel to each other and in a manner extending in the same direction.

7. A gas insulated circuit breaker comprising:
three closed tanks, each corresponding to one phase of three phases and filled with insulation gas;
at least one pair of separable contacts disposed in each of said closed tanks;
a common supporting frame supporting said three closed tanks;
a common opening spring for performing an opening operation of said pairs of separable contacts;
a common closing spring for performing a closing operation of said pairs of separable contacts;
a common actuating mechanism box accommodating an opening coil which is adapted to receive a circuit opening command for said pairs of separable contacts, a closing coil which is adapted to receive a circuit closing command for said pairs of separable contacts and an actuating mechanism for rendering said common opening spring and said common closing spring operative in response to an activation of said opening coil and said closing coil, respectively, wherein both said common opening spring and said common closing spring are disposed outside said common actuating mechanism box;
a first spring casing accommodating said common closing spring, disposed between adjacent closed tanks and supported and secured on said adjacent closed tanks; and
a second spring casing accommodating said common opening spring and supported and secured on said supporting frame.

8. A gas insulated circuit breaker according to claim 7, wherein said first spring casing and said second spring casing are arranged in parallel to each other and in a manner extending in the same direction.

* * * * *